United States Patent [19]

Stevenson, IV

[11] Patent Number: 5,065,685

[45] Date of Patent: Nov. 19, 1991

[54] MARINE SAIL WITH BATTEN ATTACHMENT ASSEMBLY

[76] Inventor: William H. Stevenson, IV, P.O. Box U, St. Michaels, Md. 21663

[21] Appl. No.: 546,834

[22] Filed: Jul. 2, 1990

[51] Int. Cl.[5] ..... B63H 9/04

[52] U.S. Cl. ..... 114/102

[58] Field of Search ..... 114/102-108

[56] References Cited

U.S. PATENT DOCUMENTS

| | | | |
|---|---|---|---|
| 2,077,685 | 4/1937 | Gerhardt | 114/103 |
| 3,444,834 | 5/1969 | Bever et al. | 114/102 |
| 3,557,733 | 1/1971 | Mathieu et al. | 114/102 |
| 4,535,825 | 8/1985 | Hackney | 114/103 |
| 4,633,798 | 1/1987 | Skinner et al. | 114/107 |
| 4,649,848 | 3/1987 | Belvedere | 114/102 |
| 4,699,073 | 10/1987 | Farneti | 114/102 |
| 4,838,192 | 6/1989 | Stevenson et al. | 114/105 |
| 4,881,480 | 11/1989 | Stevenson et al. | 114/103 |

*Primary Examiner*—Jesus D. Sotelo

*Attorney, Agent, or Firm*—Roylance, Abrams, Berdo & Goodman

[57] ABSTRACT

A marine sail having a plurality of batten attachment assemblies coupled thereto for supporting or shaping the sail body. Each of the batten attachment assemblies includes an elongated tubular pocket member, a pair of battens supported in the tubular pocket member with their longitudinal axes aligned and their inner ends overlapping, and a batten coupling and constraining assembly for limiting longitudinal movement of the battens in the tubular pocket member. In a first embodiment, the batten coupling and constraining assembly includes a pair of end caps interconnected by a pair of straps with a buckle for adjusting the compression of the battens in the tubular pocket member. In a second embodiment, the batten coupling and constraining assembly uses an elastic strap for interconnecting the pair of end caps for placing the battens under compression. In a third embodiment, the batten coupling and constraining assembly uses a pair of straps which are selectively positionable in the tubular pocket member for adjusting the amount of compression of the battens.

44 Claims, 3 Drawing Sheets

MARINE SAIL WITH BATTEN ATTACHMENT ASSEMBLY

FIELD OF THE INVENTION

This invention relates to marine sails having battens. More specifically, this invention relates to a batten attachment assembly which is coupled to a sail for relatively easy and rapid coupling and uncoupling of battens to the sail. The batten attachment assembly utilizes an elongated pocket for selectively supporting a pair of battens therein, and a batten coupling and constraining assembly for limiting movement of the battens in the pocket and for selectively coupling the battens with their longitudinal axes substantially aligned.

BACKGROUND OF THE INVENTION

Battens are used extensively with sails, such as on sailboats, to support and/or shape the sails. Depending upon the sail and the use of the sail, various arrangements of battens are utilized, such as a full battened sail, a staggered full battened sail, or a partial battened sail. For example, racing sailboats use high performance sails with a high degree of roach which usually require battens along the leech edges of the sails to maintain the proper shaped of the sails.

In partial battened sails, battens are usually coupled to the sail body by pockets extending from the leech edge of the sail only a part of the entire length of the sail. On the other hand, full battened sails have battens coupled to the sail body by pockets that extend the entire length of the sail, i.e., from the leech edge to the luff edge. Typically, the battens of a full battened sail are longer than the length of their respective pockets for compressing and bowing the batten in the pocket to obtain the desired curvature of the sail between its leech and luff edges.

Examples of prior sails with battens are disclosed in U.S. Pat. Nos. 2,077,685 to Gerhardt; 3,557,733 to Mathieu et al; 4,535,825 to Hackney; 4,633,798 to Skinner et al; 4,699,073 to Farneti; 4,838,192 to Stevenson, IV et al; and 4,881,480 to Stevenson, IV. However, these prior sails have several disadvantages.

For example, full battens are often quite large and difficult to handle and install into the pockets. Moreover, these large battens are difficult and costly to ship to customers and to store by the customers. Large battens are also more costly to manufacture and to replace if broken. Also, these prior sails typically require specially designed battens for varying the stiffness along the length of the battens. Furthermore, most prior sails have their batten pockets opening and closing at their ends for inserting the batten. Accordingly, these types of sail pockets must be specially constructed to withstand the load of the batten therein, which is usually held under compression by the pocket. Another problem with many of these prior sails is tearing of the sail by the battens during heavy loads due to high or gusty winds.

In view of the above, it is apparent that there exists a need for an improved batten assembly which provides greater flexibility in sail configuration, simpler batten installation and which is relatively inexpensive. This invention addresses these needs in the art along with other needs which will be come apparent to those skilled in the art once given this disclosure.

SUMMARY OF THE INVENTION

Accordingly, a primary object of the invention is to provide a marine sail with full battens which utilizes a pair of battens coupled to the sail with the longitudinal axes of the battens being substantially aligned.

Another object of the invention is to provide a marine sail with battens which can have their stiffnesses varied along the length of the battens.

Another object of the invention is to provide a marine sail with battens that is relatively inexpensive and easy to ship to the customer and store.

A further object of the invention is to provide a marine sail with battens that is relatively simple and less expensive to manufacture.

A further object of the invention is to provide a marine sail with battens that is relatively simple and less expensive to repair if a batten breaks.

Yet another object of the invention is to provide a marine sail with battens in which the compression of the battens can be adjusted.

Still another object of the invention is to provide a marine sail with a batten assembly that reduces breakage of the battens or tearing of the sail.

The foregoing objects are basically attained by a batten attachment assembly for a marine sail, the combination comprising: first and second battens, each of the battens having first and second ends with a longitudinal axis extending between the first and second ends; a pocket adapted to be coupled to a sail body for supporting the battens in their operative positions relative to the sail body; and a coupling assembly for coupling the battens in the pocket with the longitudinal axes of the battens being substantially aligned.

The foregoing objects are also basically attained by a marine sail, the combination comprising: a generally triangular sail body having a first edge, a second edge, and a third edge; first and second battens, each of the battens having first and second ends with a longitudinal axis extending between the first and second ends; a pocket coupled to the sail body for supporting the battens in their operative positions relative to the sail body; and a coupling assembly for coupling the battens in the pocket with the longitudinal axes of the battens being substantially aligned.

The foregoing objects are also attained by a batten attachment assembly for a marine sail, the combination comprising: at least one batten having first and second ends with a longitudinal axis extending between the first and second ends; a pocket adapted to be coupled to a sail body for supporting the batten between the first and second edges of the sail body, the pocket having a first end portion and a second end portion with the length between the first and second end portions being greater than the length of the batten; and a first constraining assembly coupled to the second end of the batten and located within the pocket for limiting longitudinal movement of the batten in the pocket.

Other objects, advantages and salient features of the invention will become apparent from the following detailed description, which, taken in conjunction with the annexed drawings, discloses three preferred embodiments of the invention.

BRIEF DESCRIPTION OF THE DRAWINGS

Referring to drawings which form part of this original disclosure.

DETAILED DESCRIPTION OF THE INVENTION

Figure 1:
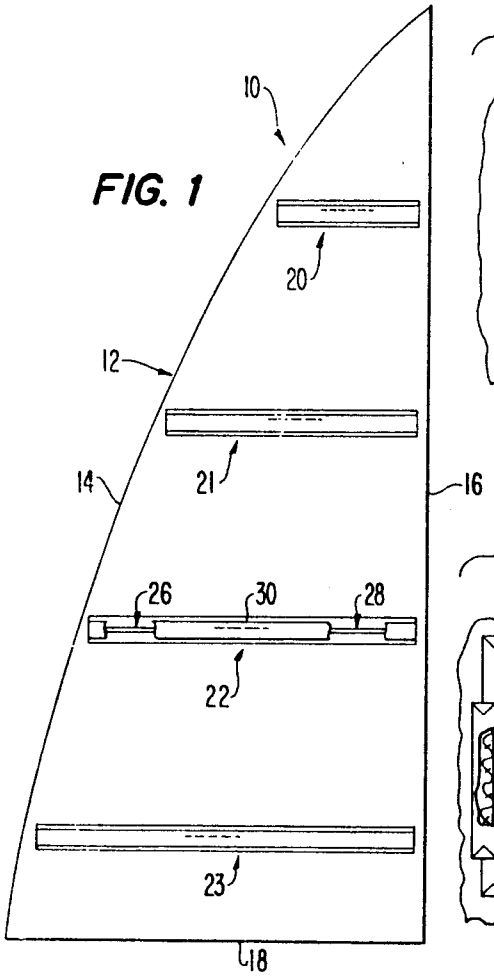
FIG. 1 is a side elevational view of a mainsail with four batten attachment assemblies coupled thereto in accordance with a first embodiment of the present invention.

Initially referring to FIG. 1, a marine sail 10 in accordance with the present invention is illustrated, and includes a sail body 12 having a generally triangular shape with a first or leech edge 14, a second or luff edge 16 and a third or foot edge 18. Sail body 12 is preferably made of a conventional flexible sail material such as Dacron.

A plurality of batten attachment assemblies 20, 21, 22 and 23 are coupled to sail body 12 between leech edge 14 and luff edge 16 and parallel to foot edge 78. Preferably, batten attachment assemblies 20–23 are sewn to sail body 12 in a conventional manner. Each of the batten attachment assemblies 20–23 preferably has a pair of elongated, resilient battens positioned in a tubular pocket member with their longitudinal axes substantially aligned and their inner ends overlapping each other. For example, batten attachment assembly 22 has an aft batten 26 and a forward batten 28 supported in a tubular pocket member 30 which is coupled to sail body 12.

Only batten attachment assembly 22 will be discussed in detail since each of the batten attachment assemblies 20–23 are substantially identical, except for being different lengths.

Figure 2:
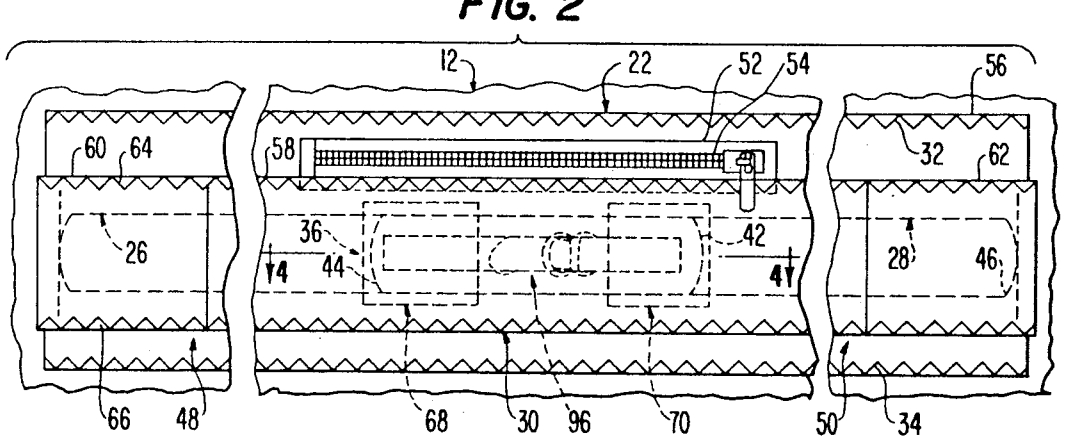
FIG. 2 is an enlarged, partial side elevational view of one of the batten attachment assemblies illustrated in FIG. 1.
Figure 3:
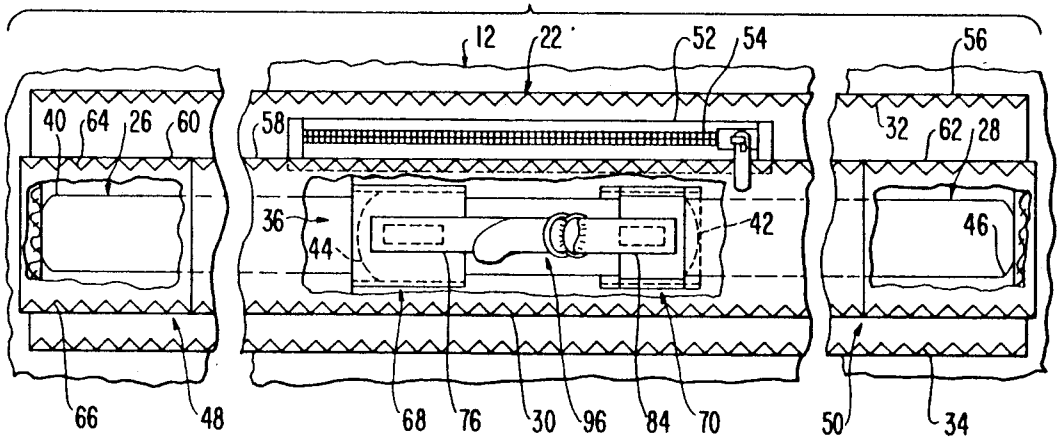
FIG. 3 is an enlarged, partial side elevational view of the batten attachment assembly illustrated in FIG. 2 with portions of the tubular pocket member broken away.
Figure 4:
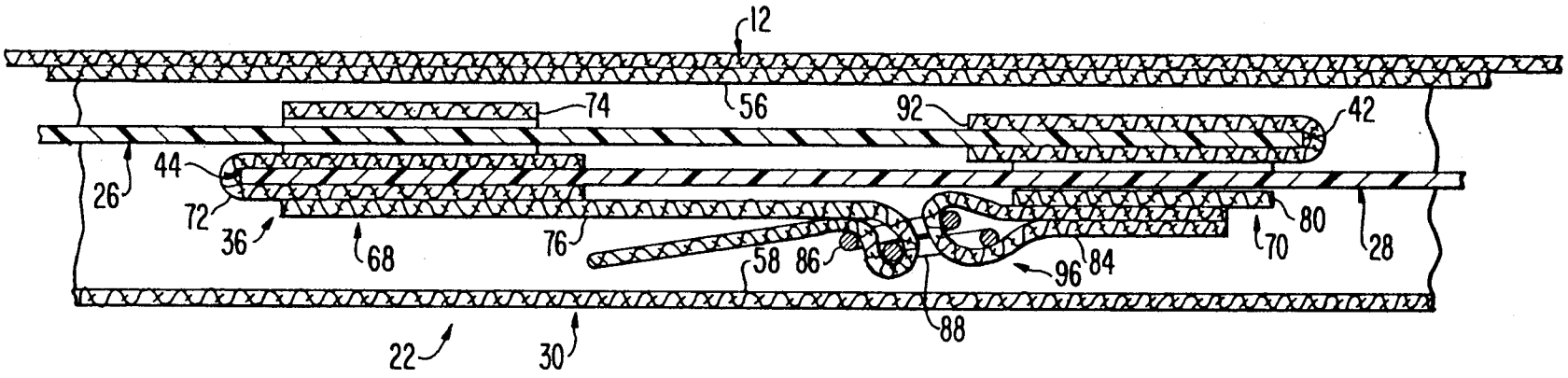
FIG. 4 is an enlarged, partial top plan view in cross section of the sail and batten attachment assembly taken along line 4—4 of FIG. 2.

Referring now to FIGS. 2–4, batten attachment assembly 22 is coupled to sail body 12 by stitching 32 and 34, and includes a first or aft batten 26, a second or forward batten 28, a continuous, tubular pocket member 30 and a batten coupling and constraining assembly 36.

Battens 26 and 28 can vary in dimensions, stiffness and material depending upon the size of the sail and the intended use of the sail, i.e., for racing or for pleasure. Thus, for example, battens 26 and 28 can be formed from fiberglass-reinforced polymeric materials such as epoxy, or nylon. Preferably, battens 26 and 28 are elongated with a substantially flat, rectangular cross section having their dimensions ranging from about 1/16 inch to about ¼ inch in thickness and ranging from about ⅛ inch to about 2 inches in width. Battens 26 and 28 can be solid or tubular with various cross sectional shapes such as round or polygonal shapes. In any case, battens 26 and 28 are made of a resilient, flexible material having sufficient stiffness to support the portion of sail body 12 adjacent thereto.

Batten 26 has a first end 40 and a second end 42 with its longitudinal axis extending therebetween. Batten 28 has a first end 44 and a second end 46 with its longitudinal axis extending therebetween.

Tubular pocket member 30 is preferably straight and continuous and has a first end portion 48, a second end portion 50 and a central opening 52 along its upper edge. Battens 26 and 28 are inserted into and removed from tubular pocket member 30 via opening 52. Opening 52 has a zipper 54 or other suitable fastener for selectively opening and closing opening 52. The lengths of battens 26 and 28 and tubular pocket member 30 are such that first end 40 of batten 26 contacts first end portion 48 of tubular pocket member 30, second end 42 of batten 26 overlaps a portion of first end 44 of batten 28, and second end 46 of batten 28 contacts second end portion 50 of tubular pocket member 30.

As seen in FIGS. 3 and 4, tubular pocket member 30 is constructed of a substantially rectangular first or inner layer 56 coupled to sail body 12, a substantially rectangular second or outer layer 58 coupled to inner layer 56, and a pair of end reinforcement layers 60 and 62 coupled to inner and outer layers 56 and 58 at end portions 48 and 50 of tubular pocket member 30, respectively.

In particular, outer layer 58 is sewn along its upper and lower longitudinal edges to inner layer 56 by stitching 64 and 66 for forming an elongated tube between inner and outer layers 56 and 58. The end portions of outer layer 58 are doubled over the end portions of inner layer 56 and sewn thereto by stitching 64 and 66 for closing the ends of tubular pocket member 30. Reinforcement layers 60 and 62 are sleeves or tubes closed at one end and are also sewn to the first and second end portions 48 and 50, respectively, by stitching 64 and 66 to overlie the end portions of inner and outer layers 56 and 58 for reinforcing end portions 48 and 50 of tubular pocket member 30.

Figure 5:
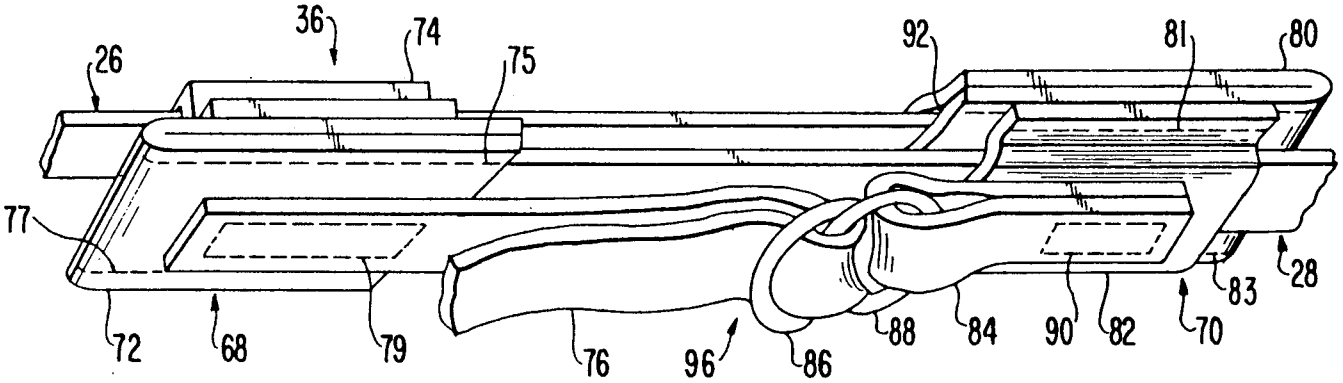
FIG. 5 is an enlarged, side perspective view of the batten coupling and constraining assembly illustrated in FIGS. 2 and 3 with the end portions of the battens being coupled thereto.

Referring specifically to FIGS. 4 and 5, batten coupling and constraining assembly 36 includes a first constraining member 68 releasably coupled to first end 44 of forward batten 28 for limiting longitudinal movement of batten 28 in tubular pocket member 30, and a second constraining member 70 releasably coupled to second end 42 of aft batten 26 for limiting longitudinal movement of batten 26 in tubular pocket member 30.

First constraining member 68 includes an end cap 72, an open-ended sleeve 74 sewn to a first side of end cap 72 via stitching 75 and 77, and a flexible strap or connecting member 76 sewn to the opposite or second side of end cap 72 via stitching 79. In particular, end cap 72 is a sleeve or tube closed at one end and is constructed by folding a rectangular piece of flexible cloth in half and sewing along the two edges perpendicular to the folded edges to form a slot 78. The same stitching 75 and 77 used to couple sleeve 74 to end cap 72 can also be used to construct end cap 72. Preferably, sleeve 74 and end cap 72 are formed of a flexible material, such as Dacron. Strap 76 can be made of a non-elastic material, an elastic material or a combination of elastic and non-elastic materials.

Second constraining member 70, includes an end cap 80, an open-ended sleeve 82 sewn to a first side of end cap 80 via stitching 81 and 83, a flexible strap or connecting member 84 sewn to sleeve 82, and a pair of metallic rings 86 and 88. End cap 80 is constructed in a similar manner to end cap 72, i.e., by folding a rectangular piece of flexible cloth in half and sewing along the two edges perpendicular to the folded edge to form a slot 92. Rings 86 and 88 are coupled to strap 84 by threading strap 84 through rings 86 and 88 and then sewing the free ends of strap 84 together. Strap 84 is a rectangular piece of flexible cloth which is folded in half to form a loop containing metallic rings 86 and 88 and then sewing the free ends of strap 84 to sleeve 82 by stitching 90.

Straps 76 and 84 together with rings 86 and 88 form a buckle 96 for adjusting the compression forces placed on battens 26 and 28.

As seen in FIGS. 4 and 5, constraining members 68 and 70 are located in pocket member 30 and coupled to the inner ends of the battens 26 and 28 for resisting movement of battens 26 and 28 relative to pocket member 30, and for orienting the longitudinal axes of battens 26 and 28 substantially parallel to the longitudinal axis of pocket member 30.

Installation

To install the present invention on a sail, first batten attachment assembly 22 is constructed as described above, and then sewn to sail body 12 by stitching 32 and 34. Then, a pair of battens 26 and 28 are selected with the desired stiffness and inserted into tubular pocket 30 through opening 52. Battens 26 and 28 should be of sufficient length such that first end 40 of batten 26 and second end 46 of batten 28 contact the ends tubular of pocket member 30, while second end 42 of batten 26 and first end of batten 28 overlap. Next, batten coupling and constraining assembly 36 is coupled to the battens 26 and 28 by sliding sleeve 74 of first constraining member 68 over second end 42 of batten 26 and sliding sleeve 82 over first end 44 of second batten 28. Sleeves 74 and 82 restrict transverse movement of battens 26 and 28 to maintain substantial longitudinal alignment of battens 26 and 28. Now, second end 42 of first batten 26 is slid into slot 78 of end cap 72 of first constraining member 68, and first end 44 of second batten 28 is slide into slot 92 of end cap 80 of second constraining member 70, which also restrict transverse movement of the battens. Finally, straps 76 and 84 are coupled together via rings 86 and 88 to place the battens 26 and 28 in compression. In particular, battens 26 and 28 are held in compression by tightening buckle 96 to tend to move first and second constraining members 68 and 70 towards one another and thereby exert a longitudinal force along the lengths of battens 26 and 28, which are constrained from longitudinal movement by batten coupling and constraining assembly 36, especially end caps 72 and 80, and the end portions 48 and 50 of tubular pocket member 30.

Figure 6:
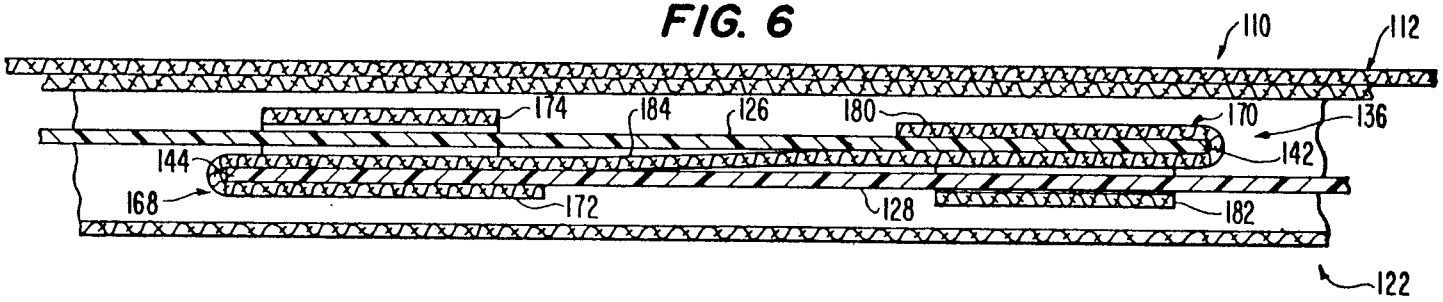
FIG. 6 is an enlarged, partial top plan view in cross section of a second embodiment of a marine sail with a batten attachment assembly utilizing a modified batten coupling and constraining assembly in accordance with the present invention.
Figure 7:
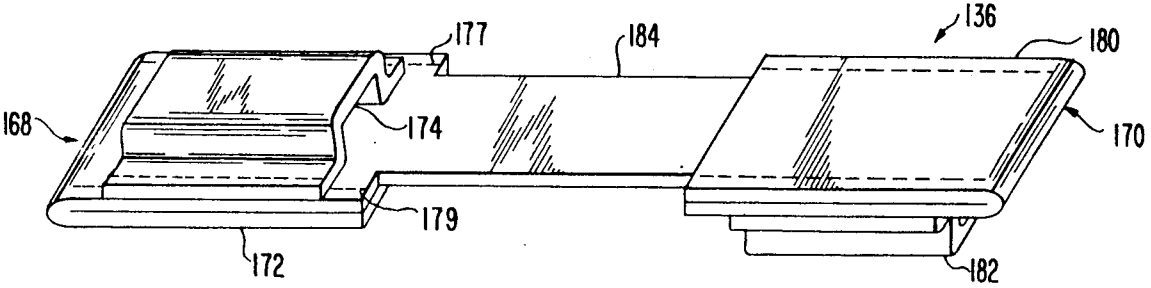
FIG. 7 is an enlarged, side perspective view of the modified batten coupling and constraining assembly illustrated in FIG. 6.

Batten Attachment Assembly of FIGS. 6 and 7

Referring now to FIGS. 6 and 7, a second embodiment of a marine sail 110 in accordance with the present invention is illustrated, and includes a sail body 112 and a plurality of batten attachment assemblies 122 coupled to sail body 112 by stitching. Sail body 112 and batten attachment assembly 122 are substantially identical to sail body 12 and batten attachment assembly 22, except that batten coupling and restraining assembly 36 has been replaced with a modified batten coupling and restraining assembly 136. Accordingly, only batten coupling and constraining assembly 136 will be discussed in detail.

Batten coupling and constraining 136 includes a first constraining member 168 releasably coupled to first end 144 of forward batten 128, a second constraining member 170 releasably coupled to second end 142 of aft batten 126, and a flexible strap or connecting member 184 interconnecting constraining members 168 and 170.

First constraining member 168 includes an end cap 172 and an open-ended sleeve 174 sewn to a first side of end cap 172 via stitching 177 and 179. Second constraining member 170 includes an end cap 180 and an open-ended sleeve 182 sewn to a first side of end cap 180 via stitching.

Strap 184 is made of a flexible, elastic material which interconnects constraining members 168 and 170 for adjusting the distance between constraining members 168 and 170. As seen in FIGS. 6 and 7, strap 184 and constraining members 168 and 170 can be made of a single sheet of flexible, elastic material. However, constraining members 168 and 170 can also be constructed of a flexible, non-elastic material, while strap 184 is made of either an elastic material or a combination of elastic and non-elastic materials.

Batten coupling and constraining 136 is coupled to batten 126 and 128 in a substantially similar manner as batten coupling and constraining assembly 36, except that rather than buckling constraining members 168 and 170 together to place the battens 126 and 128 under compression, the elastic portion of strap 184 is slightly stretched and thereby places the battens 126 and 128 under compression due to its elastic properties.

Figure 8:
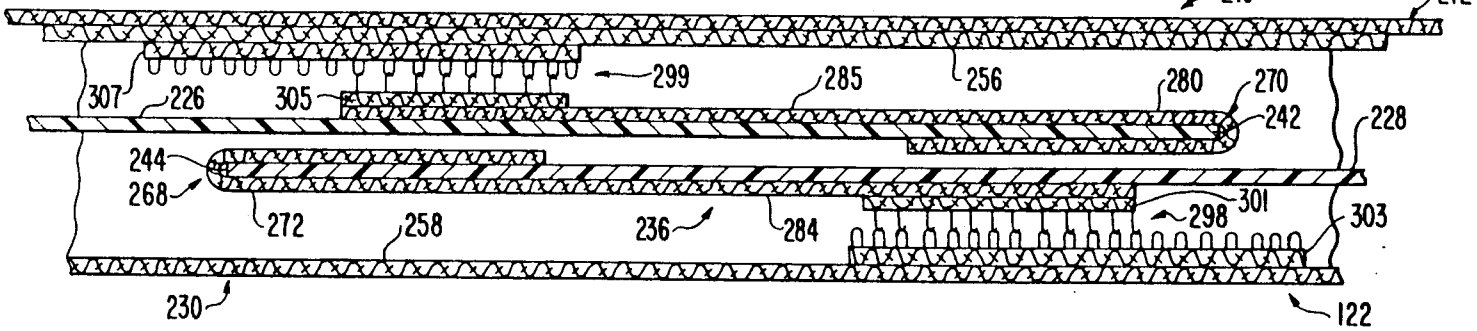
FIG. 8 is an enlarged, partial top plan view in cross section of a third embodiment of a marine sail with a batten attachment assembly utilizing a modified batten coupling and constraining assembly in accordance with the present invention.

Batten Attachment Assembly of FIG. 8

Referring to FIG. 8, a third embodiment of a marine sail 210 is illustrated in accordance with the present invention, and includes a sail body 212 having a plurality of batten attachment assemblies 222 coupled thereto by stitching. Sail body 212 and batten attachment assembly 222 are substantially identical to sail body 12 and batten attachment assembly 22, except that batten coupling and constraining assembly 36 has been replaced with a modified batten coupling and constraining assembly 236. Accordingly, only batten coupling and constraining 236 will be discussed in detail.

Batten coupling and constraining assembly 236 includes a first constraining member 268 releasably coupled to first end 244 of forward batten 228, and a second constraining member 270 releasably coupled to second end 242 of aft batten 226.

First constraining member 268 includes an end cap 272 and a flexible strap 284 integrally formed therewith. The free end of strap 284 is releasably and longitudinally adjustably coupled to outer layer 258 of tubular pocket member 230 via a suitable fastener 298. Preferably, fastener 298 is a hook and loop fastener, such as the hook and loop fastener sold under the trademark VELCRO, comprising a hook portion 301 rigidly coupled, such as by stitching, to strap 284, and a loop portion 303 rigidly coupled, such as by stitching, to outer layer 258.

Second constraining member 270 includes an end cap 280 and a flexible strap 285 integrally formed therewith The free end of strap 285 is releasably and longitudinally adjustably coupled to inner layer 256 of tubular pocket member 230 via a suitable fattener 299. Preferably, fastener 299 is a hook and loop fastener, such as the hook and loop fastener sold under the trademark VELCRO, comprising a hook portion 305 rigidly coupled to strap 285 and a loop portion 307 rigidly coupled to inner layer 256.

Accordingly, in assembling batten coupling and constraining assembly 236, end cap 272 of first constraining member 268 is slid onto first end 244 of batten 228, and end cap 280 is slid on the second end 242 of batten 226. Then, straps 284 and 285 are pulled tight and towards one end of the pocket member until the battens 226 and 228 are placed under the desired amount of compression against the respective end portion of the pocket member and then fastened to tubular pocket member 230 via the respective fasteners 298 and 299 to hold the battens 226 and 228 under compression. Straps 284 and 285 are selectively positionable in the pocket member 230 via selective longitudinal coupling of the fasteners 298 and 299 to adjustably exert compressive forces on the battens 226 and 228.

This embodiment of FIG. 8 has the advantage of the over the other embodiments disclosed herein, in that this embodiment allows for use of only one batten in tubular pocket member 230. Thus, sail 210 can be setup as either a partially battened or full battened sail.

While only three embodiments have been chosen to illustrate the invention, it will be understood by those skilled in the art that various changes and modifications can be made herein without departing from the scope of the invention as defined in the appended claims.

What is claimed is:

1. A batten attachment assembly for a marine sail, the combination comprising:

first and second battens, each of said battens having first and second ends with a longitudinal axis extending between said first and second ends;

pocket means, adapted to be coupled to a sail body, for supporting said battens in their operative positions relative to the sail body, said pocket means having a longitudinal axis; and means, located in said pocket means and coupled to said battens, for resisting movement of said battens relative to said pocket means, and for orienting said longitudinal axes of said battens substantially parallel to said longitudinal axis of said pocket means.

2. A batten attachment assembly according to claim 1, wherein a portion of said second end of said first batten overlaps a portion of said first end of said second batten.

3. A batten attachment assembly according to claim 1, wherein said pocket means includes first and second end portions for limiting longitudinal movement of said battens in said pocket means.

4. A batten attachment assembly according to claim 3, wherein said pocket means is a substantially continuous tubular member with an opening between said first and second end portions of said pocket means for inserting and removing said battens into and out of said pocket means, said first and second end portions being closed for abutting said first end of said first batten and said second end of said second batten, respectively.

5. A batten attachment assembly according to claim 1, wherein said means for resisting and orienting includes first and second constraining members with said first constraining member being releasably coupled to said first end of said second batten and said second constraining member being releasably coupled to said second end of said first batten.

6. A batten attachment assembly according to claim 5, wherein a portion of said second end of said first batten overlaps a portion of said first end of said second batten.

7. A batten attachment assembly according to claim 6, wherein said means for resisting and orienting further includes a connecting member coupled to said constraining members.

8. A batten attachment assembly according to claim 7, wherein said connecting member includes fastening means for releasably and adjustably coupling said constraining members together.

9. A batten attachment assembly according to claim 8, wherein said fastening means is a buckle.

10. A batten attachment assembly according to claim 7, wherein said pocket means includes first and second end portions for limiting longitudinal movement of said battens in said pocket means.

11. A batten attachment assembly according to claim 10, wherein said connecting member is adjustable in length to exert a force upon said first batten towards said first end portion of said pocket means, and to exert a force upon said second batten towards said second end portion for placing said first and second battens under compression.

12. A batten attachment assembly according to claim 11, wherein said connecting member includes an elastic portion for adjusting the length of said connecting member.

13. A batten attachment assembly according to claim 11, wherein said connecting member includes fastening means for adjusting the length of said connecting member.

14. A batten attachment assembly according to claim 11, wherein each of said first and second constraining members has an end cap slideably coupled over said first end of said second batten and said second end of said first batten, respectively.

15. A batten attachment assembly according to claim 14, wherein said first constraining member has a sleeve for slideably receiving said first batten therethrough, and said second constraining member has a sleeve for slideably receiving said second batten therethrough.

16. A batten attachment assembly according to claim 6, wherein each of said first and second constraining members includes fastening means for coupling said constraining members to said pocket means.

17. A batten attachment assembly according to claim 16, wherein said fastening means of said first and second constraining members are releasably coupled to said pocket means.

18. A batten attachment assembly according to claim 16, wherein said fastening means of said first and second constraining members are adjustably coupled to said pocket means.

19. A batten attachment assembly according to claim 8, wherein said fastening means are hook and loop fasteners.

20. A batten attachment assembly according to claim 6, wherein said pocket means includes first and second end portions for limiting longitudinal movement of said battens in said pocket means.

21. A batten attachment assembly according to claim 20, wherein said first constraining member is selectively positionable in said pocket means to exert a force upon said second batten towards said second end portion of said pocket means for placing said second batten under compression, and said second constraining member is selectively positionable in said pocket means to exert a force upon said first batten towards said first end portion of said pocket means for placing said first batten under compression.

22. A marine sail, the combination comprising:

a generally triangular sail body having a first edge, a second edge, and a third edge;

first and second battens, each of said battens having first and second ends with a longitudinal axis extending between said first and second ends;

pocket means, coupled to said sail body, for supporting said battens in their operative positions relative to said sail body said pocket means having a longitudinal axis; and means, located in said pocket means and coupled to said battens, for resisting movement of said battens relative to said pocket means, and for orienting said longitudinal axes of said battens substantially parallel to said longitudinal axis of said pocket means.

23. A marine sail according to claim 22, wherein said pocket means is a substantially continuous tubular member with an opening between first and second end portions of said pocket means for inserting and removing said battens into and out of said pocket means, said first and second end portions being closed for abutting said first end of said first batten and said second end of said second batten, respectively.

24. A marine sail according to claim 22, wherein said means for resisting and orienting includes first and second constraining members with said first constraining member being releasably coupled to said first end of said second batten and said second constraining member being releasably coupled to said second end of said first batten.

25. A marine sail according to claim 24, wherein a portion of said second end of said first batten overlaps a portion of said first end of said second batten.

26. A marine sail according to claim 25, wherein each of said first and second constraining members includes fastening means for coupling said constraining members to said pocket means.

27. A marine sail according to claim 26, wherein said fastening means of said first and second constraining members are releasably coupled to said pocket means.

28. A marine sail according to claim 26, wherein said fastening means of said first and second constraining members are adjustably coupled to said pocket means.

29. A marine sail according to claim 28, wherein said fastening means are hook and loop fasteners.

30. A marine sail according to claim 26, wherein said pocket means includes first and second end portions for limiting longitudinal movement of said battens in said pocket means.

31. A marine sail according to claim 30, wherein said first constraining member is selectively positionable in said pocket means to exert a force upon said second batten towards said second end portion of said pocket means for placing said second batten under compression, and said second constraining member is selectively positionable in said pocket means to exert a force upon said first batten towards said first end portion of said pocket means for placing said first batten under compression.

32. A marine sail according to claim 24, wherein said means for resisting and orienting further includes a connecting member coupled to said constraining members.

33. A marine sail according to claim 32, wherein said connecting member includes fastening means for releasably and adjustably coupling said constraining members together.

34. A marine sail according to claim 33, wherein said fastening means is a buckle.

35. A marine sail according to claim 32, wherein said pocket means includes first and second end portions for limiting longitudinal movement of said battens in said pocket means.

36. A marine sail according to claim 35, wherein said connecting member is adjustable in length to exert a force upon said first batten towards said first end portion of said pocket means, and to exert a force upon said second batten towards said second end portion for placing said first and second battens under compression.

37. A marine sail according to claim 36, wherein said connecting member includes an elastic portion for adjusting the length of said connecting member.

38. A marine sail according to claim 36, wherein said connecting member includes fastening means for adjusting the length of said connecting member.

39. A marine sail according to claim 36, wherein each of said first and second constraining members has an end cap slideably coupled over said first end of said second batten and said second end of said first batten, respectively.

40. A marine sail according to claim 39, wherein said first constraining member has a sleeve for slideably receiving said first batten therethrough, and said second constraining member has a sleeve for slideably receiving said second batten therethrough.

41. A batten attachment assembly for a marine sail, the combination comprising:

a first batten having first and second ends with a longitudinal axis extending between said first and second ends;

pocket means, adapted to be coupled to a sail body, for supporting said first batten between first and second edges of the sail body, said pocket means having a first end portion and a second end portion with the length between said first and second end portions being substantially greater than the length of said first batten;

first constraining means coupled to said second end of said first batten and located within said pocket means, for limiting longitudinal movement of said first batten in said pocket means; and fastening means for releasably coupling and uncoupling said first constraining means to said pocket means, said fastening means having a first portion fixedly coupled to said first constraining means and a second portion fixedly coupled to said pocket means with said first and second portions being releasably coupled and uncoupled together.

42. A batten attachment assembly for a marine sail, the combination comprising:

a first batten having first and second ends with a longitudinal axis extending between said first and second ends;

pocket means, adapted to be coupled to a sail body, for supporting said first batten between first and second edges of the sail body, said pocket means having a first end portion and a second end portion with the length between said first and second end portions being substantially greater than the length of said first batten;

first constraining means, coupled to said second end of said first batten and located within said pocket means, for limiting longitudinal movement of said first batten in said pocket means;

a second batten having first and second ends with a longitudinal axis extending between said first and second ends, said second batten being substantially smaller in length than the length of said pocket means between said first and second end portions; and second constraining means, coupled to said first end of said second batten and located within said pocket means, for limiting longitudinal movement of said second batten in said pocket means.

43. A batten attachment assembly according to claim 42, wherein a portion of said second end of said first batten overlaps a portion of said first end of said second batten.

44. A batten attachment assembly according to claim 43, wherein said first and second constraining means are selectively positionable in said pocket means are selectively positionable in said pocket means for exerting a force upon said first batten and said second batten, respectively, to place them in compression.

* * * * *